US010202988B2

(12) United States Patent
Stander

(10) Patent No.: US 10,202,988 B2
(45) Date of Patent: Feb. 12, 2019

(54) CUSHION MECHANISM FOR A HYDRAULIC CYLINDER

(71) Applicant: Deere & Company, Moline, IL (US)

(72) Inventor: Francois Stander, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 291 days.

(21) Appl. No.: 15/185,578

(22) Filed: Jun. 17, 2016

(65) Prior Publication Data

US 2017/0363120 A1 Dec. 21, 2017

(51) Int. Cl.
*F15B 15/22* (2006.01)

(52) U.S. Cl.
CPC ..... *F15B 15/223* (2013.01); *F15B 15/226* (2013.01); *F15B 15/227* (2013.01)

(58) Field of Classification Search
CPC .... F15B 15/222; F15B 15/223; F15B 15/225; F15B 15/227
USPC ..... 91/405, 409; 92/85 B
See application file for complete search history.

(56) References Cited

U.S. PATENT DOCUMENTS 1,902,018 A * 3/1933 Davis ..... D06F 1/067 91/403
2,553,810 A * 5/1951 Carlson ..... F15B 15/222 188/284
3,998,132 A * 12/1976 Rasigade ..... F15B 15/225 91/395
4,638,717 A * 1/1987 Carr ..... F15B 15/227 91/26
4,706,781 A * 11/1987 Ikimi ..... F15B 15/227 187/234
5,125,325 A * 6/1992 Czukkermann ..... F15B 15/223 91/407
5,680,913 A * 10/1997 Wood ..... F15B 15/222 188/285
6,038,956 A 3/2000 Lane
6,186,043 B1 2/2001 Callies
8,578,837 B1 11/2013 Burhoe
9,926,178 B2 * 3/2018 Okroy ..... F15B 15/227
2016/0052759 A1 * 2/2016 Okroy ..... F15B 15/227 92/165 R

FOREIGN PATENT DOCUMENTS

CA 999215 11/1976

* cited by examiner

*Primary Examiner* — Michael Leslie
(74) *Attorney, Agent, or Firm* — Michael Best & Friedrich LLP

(57) ABSTRACT

A hydraulic assembly includes a barrel having a head port disposed proximate an end of the barrel, a piston assembly disposed within the barrel and movable relative thereto, the piston assembly including a bore terminating at a back wall, the bore defining a longitudinal axis, and a plunger at least partially received within the bore and translatable along the longitudinal axis. The plunger includes a main body having an end facing the head port, a shoulder extending radially-outwardly from the main body, and a passageway extending through the main body. A spring is disposed in a first region defined between the shoulder and the back wall, the spring configured to exert a biasing force on the shoulder.

19 Claims, 7 Drawing Sheets

CUSHION MECHANISM FOR A HYDRAULIC CYLINDER

BACKGROUND

The present disclosure relates to hydraulic systems, and more particularly to cushion mechanisms for hydraulic cylinders.

Hydraulic cylinders typically include a barrel and a reciprocable piston received within the barrel, and often also include a cushioning mechanism associated with the cylinder. The cushioning mechanism slows the travel of the piston when it nears the end of its stroke, preventing the piston from impacting the end of the barrel at a high speed. One type of cushioning mechanism includes a spear coupled to the piston, in which the spear enters a fluid outlet port of the cylinder as the piston approaches the end of its stroke. The action of the spear entering the port increases the fluid pressure acting against the piston as the piston travels to the end of the barrel, which slows down the piston. Such a configuration, however, may result in a pressure spike in the barrel as soon as the spear enters the port due to the increased flow resistance for hydraulic fluid exiting through the port. This rapid increase in pressure could damage the cylinder or the structure to which the cylinder is mounted. Although a relief valve may be used to mitigate the pressure spike associated with cushioning, adding a relief valve adds cost and complexity to the system.

SUMMARY

In one aspect, a hydraulic assembly includes a barrel having a head port disposed proximate a first end of the barrel and a piston assembly disposed within the barrel and movable relative to the barrel. The piston assembly includes a piston having a first side in fluid communication with the head port. The first side of the piston and the first end of the barrel define a head cavity therebetween. A bore extends through the first side and terminates at a back wall. The hydraulic assembly further includes a cushion mechanism configured to slow movement of the piston assembly relative to the barrel. The cushion mechanism includes a plunger at least partially received within the bore and movable along the bore. The plunger includes a main body having an end facing the head port and a shoulder extending radially-outwardly from the main body. The cushion mechanism also includes a spring disposed in a first region defined between the shoulder and the back wall of the bore. The spring is configured to exert a spring force on the plunger to bias the plunger toward the head port. The end of the plunger is configured to enter the head port as the piston approaches the first end of the barrel, and the cushion mechanism is configured such that increased pressure within the head cavity exerts a force on the plunger to move the plunger into the bore and move the end of the plunger out of the head port.

In another aspect, a hydraulic assembly includes a barrel having a head port disposed proximate an end of the barrel and a piston assembly disposed within the barrel and movable relative thereto. The piston assembly includes a bore terminating at a back wall and defining a longitudinal axis. The hydraulic assembly also includes a cushion mechanism configured to slow movement of the piston assembly relative to the barrel. The cushion assembly includes a plunger at least partially received within the bore and translatable along the longitudinal axis. The plunger includes a main body having an end facing the head port, a shoulder extending radially-outwardly from the main body, and a passageway extending through the main body. A spring is disposed in a first region defined between the shoulder and the back wall, and the spring is configured to exert a biasing force on the shoulder. The end of the plunger is configured to enter the head port as the piston assembly approaches the end of the barrel. The cushion mechanism is configured such that increased pressure within the head cavity exerts a force on the plunger to move the plunger into the bore. The passageway is configured to allow hydraulic fluid to flow out of the first region in response to the plunger moving toward the back wall.

In yet another aspect, a hydraulic assembly includes a barrel having a head port disposed proximate an end of the barrel, a piston assembly disposed within the barrel and movable relative thereto, the piston assembly including a bore terminating at a back wall, the bore defining a longitudinal axis, and a plunger at least partially received within the bore and translatable along the longitudinal axis. The plunger includes a main body having an end facing the head port, a shoulder extending radially-outwardly from the main body, and a passageway extending through the main body. A spring is disposed in a first region defined between the shoulder and the back wall, the spring configured to exert a biasing force on the shoulder.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the accompanying drawings. The disclosure is capable of supporting other embodiments and of being practiced or of being carried out in various ways.

Figure 1:
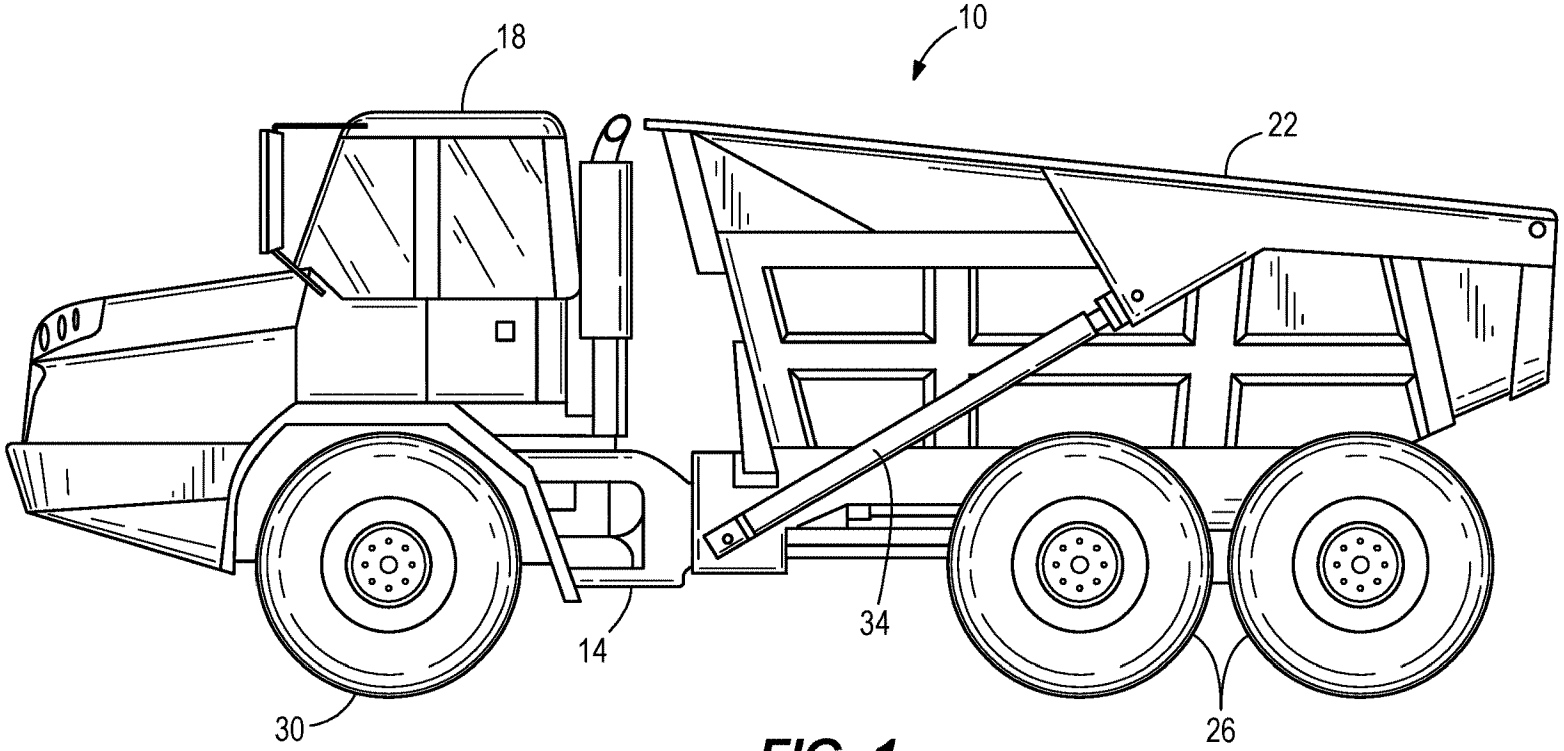
FIG. 1 is a side view of a dump truck incorporating one or more hydraulic assemblies.

FIG. 1 illustrates a dump truck 10 including a chassis 14, a cab 18, and a tiltable bed 22. A set of rear wheels 26 and a set of front wheels 30 support the chassis 14. The dump truck 10 includes a variety of hydraulic assemblies. For example, in the illustrated embodiment, a hydraulic cylinder 34 extends between the bed 22 and the chassis 14 and is extendable to tilt the bed 22 relative to the chassis 14. In addition, the front wheels 30 are coupled to a hydraulic steering system (not shown), which may include one or more hydraulic cylinders operable to turn the front wheels in response to a driver's steering input.

Figure 2:
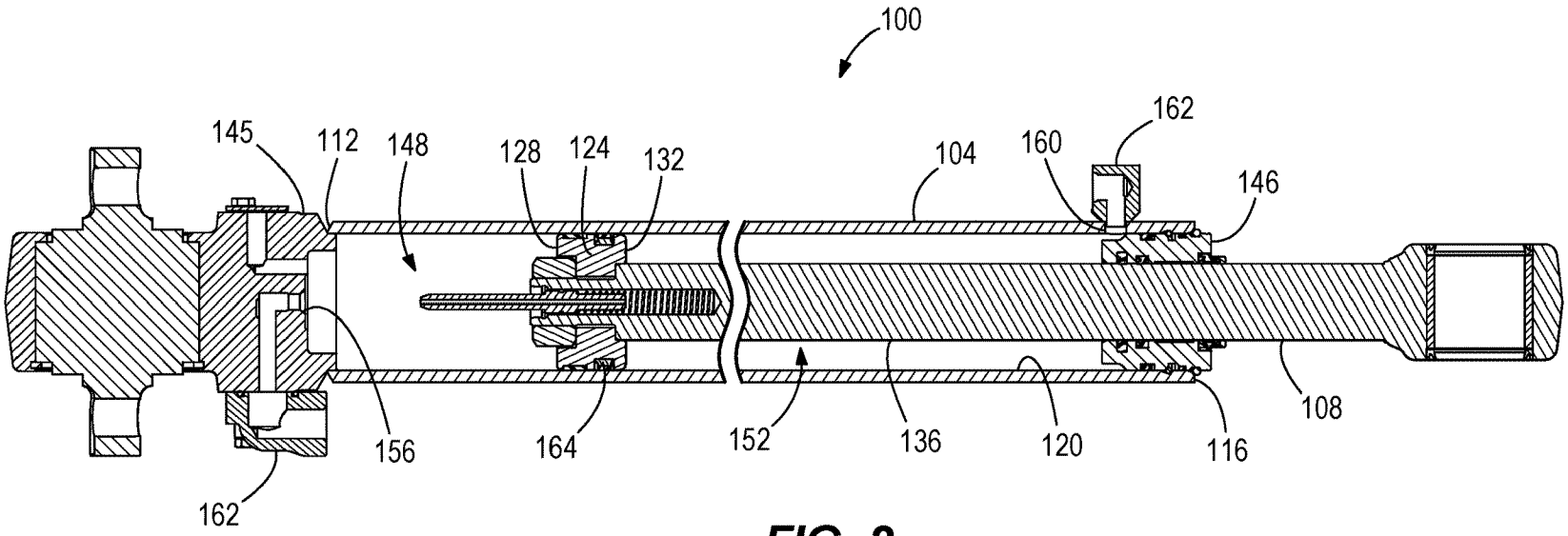
FIG. 2 is a cross-sectional view of a hydraulic assembly according to an embodiment of the disclosure.

FIG. 2 illustrates a hydraulic cylinder 100 according to one embodiment of the disclosure. The hydraulic cylinder 100 is usable with the dump truck 10 of FIG. 1 (e.g., as part of the hydraulic steering system or as the hydraulic cylinder 34) but may also be configured for use in a wide range of other applications. For example, the hydraulic cylinder 100 may be incorporated into industrial machinery, vehicles, construction equipment, tools, and the like.

The cylinder 100 includes a barrel 104 and a piston assembly 108 slidably received within the barrel 104. The barrel 104 has a head end 112, a rod end 116 opposite the head end 112, and a cylindrical inner wall 120 extending between the head and rod ends 112, 116. The piston assembly 108 includes a piston 124 having a first side 128 facing the head end 112, a second side 132 facing the rod end 116, a rod 136 coupled to the piston 124 that extends beyond the rod end 116, and a bore 140 (FIG. 3) extending into the rod 136 and terminating at a back wall 144. The piston 124 is contained within the barrel 104 by a head assembly 145 fixed to the barrel 104 proximate the head end 112 and a plug 146 fixed to the barrel 104 proximate the rod end 116. The first side 128 of the piston 124 and the head end 112 of the barrel 104 define a head cavity 148 therebetween. The second side 132 of the piston 124 and the rod end 116 of the barrel 104 define a rod cavity 152 therebetween, through which the rod 136 extends.

With reference to FIG. 2, the cylinder 100 includes a head port 156 disposed proximate the head end 112 and a rod port 160 disposed proximate the rod end 116. A hydraulic fitting 162 is coupled to each of the head port 156 and the rod port 160 to facilitate connecting the head and rod ports 156, 160 to a hydraulic fluid supply (not shown). The head port 156 fluidly communicates with the head cavity 148, and the rod port 160 fluidly communicates with the rod cavity 152. The piston 124 carries a dynamic seal 164, which forms a substantially fluid-tight seal between the piston 124 and the inner wall 120 to isolate the head cavity 148 from the rod cavity 152. In the illustrated embodiment, the piston assembly 108 is reciprocable along the barrel 104 between an extended position and a retracted position in response to the introduction of pressurized hydraulic fluid through the head port 156 and the rod port 160, respectively. As such, the illustrated cylinder 100 is a double-acting hydraulic cylinder; however, in other embodiments, the cylinder 100 may be configured as a single-acting hydraulic cylinder. For example, in some embodiments, the piston assembly 108 may be movable to the extended position or the retracted position under the influence of gravity and/or a return spring.

Figure 3:
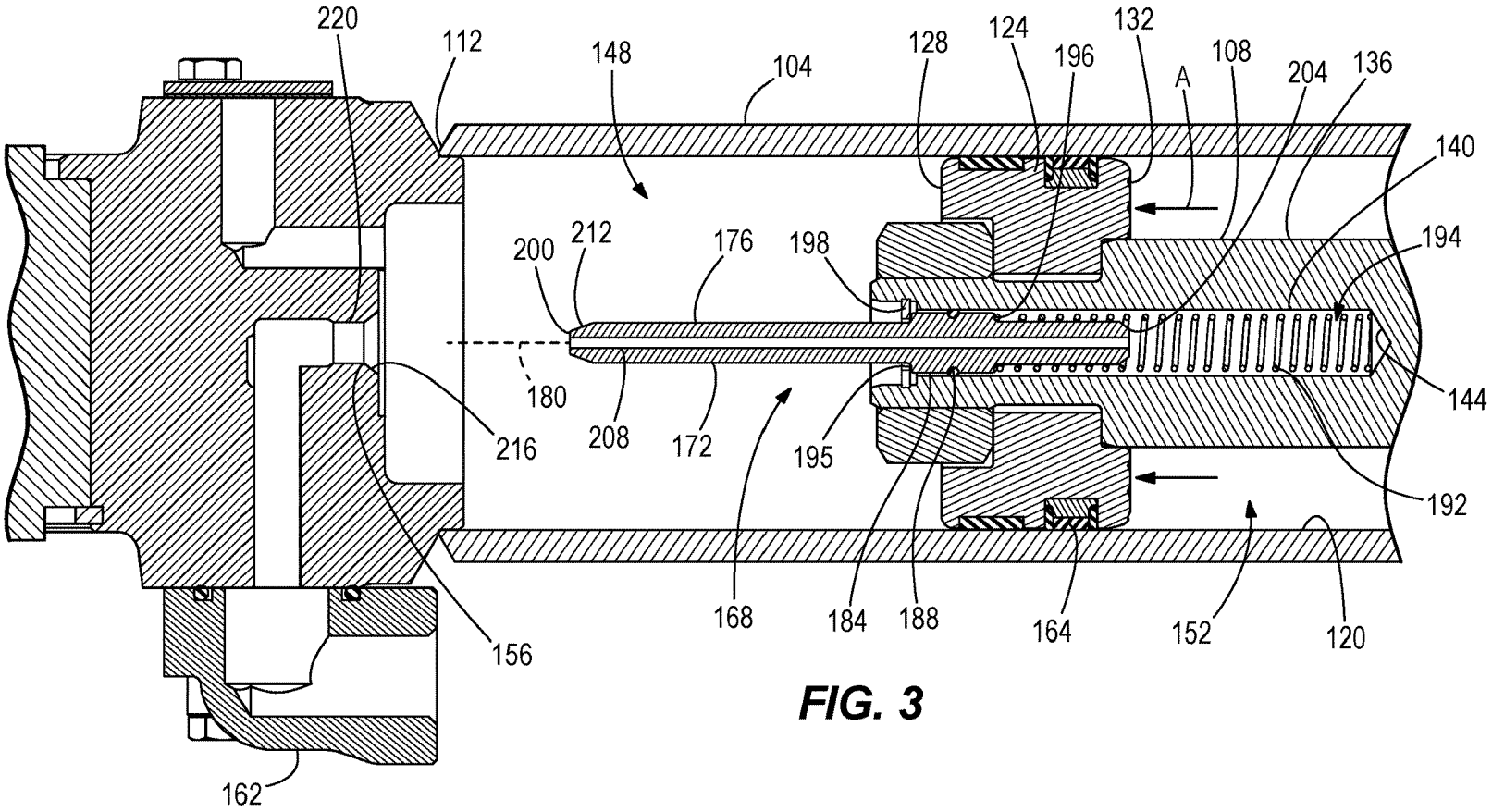
FIG. 3 is a cross-sectional view of a portion of the hydraulic assembly of FIG. 2, illustrating a piston of the hydraulic assembly moving toward a retracted position.
Figure 7:
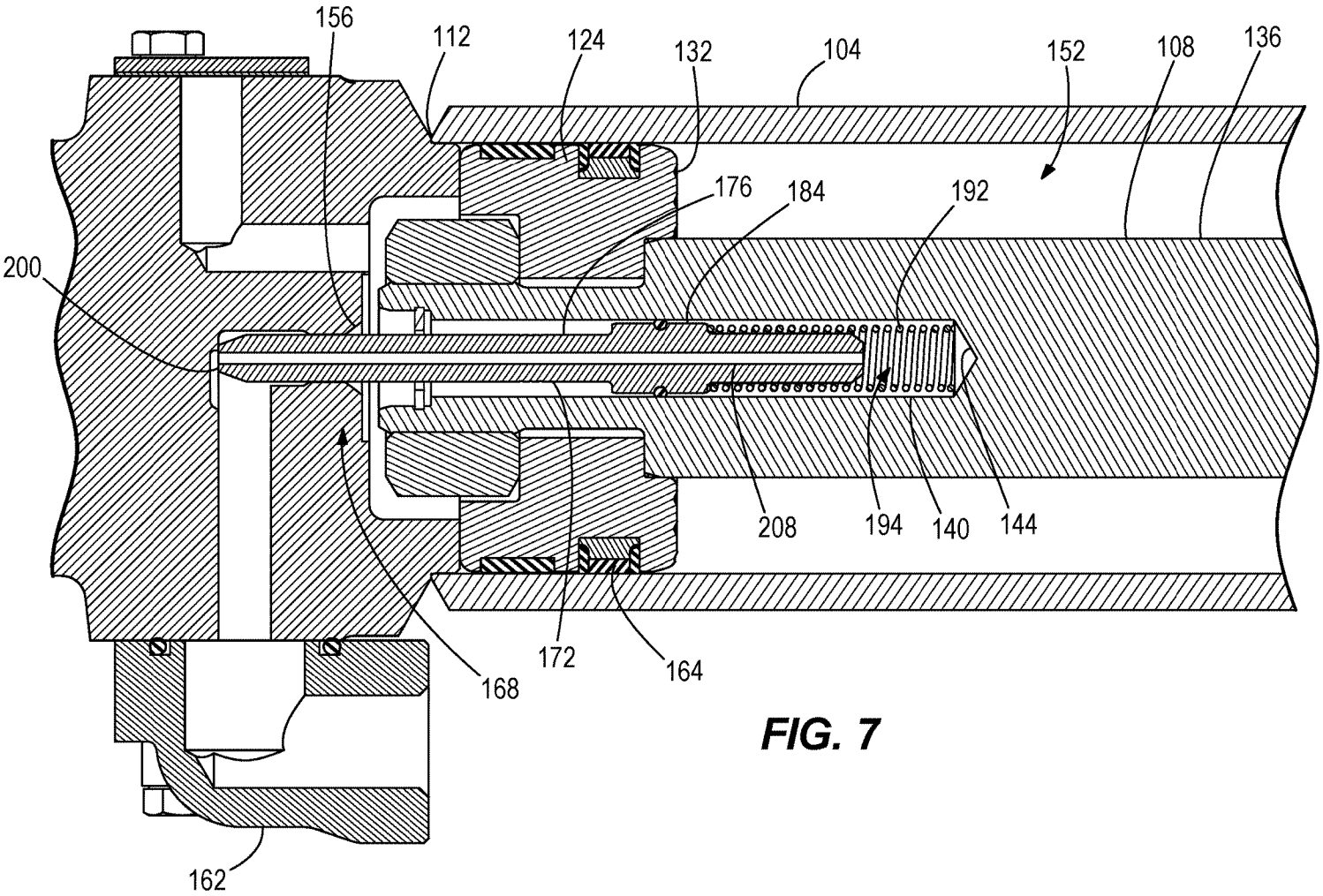
FIG. 7 is a cross-sectional view of a portion of the hydraulic assembly of FIG. 2 with the piston in the retracted position.

Referring to FIG. 3, the cylinder 100 further includes a cushion mechanism 168. The cushion mechanism 168 includes a plunger 172 having a main body 176 that defines a longitudinal axis 180 and a shoulder 184 extending radially-outwardly from the main body 176. In the illustrated embodiment, the plunger 172, the head port 156, the piston assembly 108, and the barrel 104 are all coaxial with the longitudinal axis 180. The plunger 172 is partially received within the bore 140 and is movable along the bore 140 between an extended position (FIG. 3) and a retracted position (FIG. 7). In the illustrated embodiment, a seal 188 (e.g., an O-ring) is disposed within an annular groove in the shoulder 184 to create a generally fluid-tight seal between the periphery of the shoulder 184 and the bore 140. The cushion mechanism 168 also includes a spring 192, which is a coil spring in the illustrated embodiment, disposed in a spring cavity 194 defined between the shoulder 184 and the back wall 144 of the bore 140. The shoulder 184 has a front face 195 in fluid communication with the head cavity 148 and a back face 196 in fluid communication with the spring cavity 194. The spring 192 exerts a spring force on the back face 196 of the shoulder 184 to bias the plunger 172 toward the extended position. A retaining ring 198 engages the front face 195 of the shoulder 184 to limit movement of the plunger 172 to the extended position.

With continued reference to FIG. 3, the main body 176 of the plunger 172 has a first end 200 facing the head port 156 and a second, opposite end 204 facing the back wall 144. A passageway 208 extends through the main body 176 along the longitudinal axis 180. The passageway 208 provides fluid communication between the spring cavity 194 and the first end 200 of the plunger 172. The first end 200 of the plunger 172 is sized and shaped for insertion into the head port 156 when the piston assembly 108 moves toward the head end 112 of the barrel 104. In the illustrated embodiment, the end 200 includes a tapered surface 212 that is engageable with a tapered inlet region 216 of the head port 156 to guide the plunger 172 into the head port 156. When the end 200 is inserted into the head port 156, the passageway 208 provides fluid communication between the spring cavity 194 and the interior of the head port 156.

In operation, the illustrated piston assembly 108 is movable relative to the barrel 104 between the extended position, in which an overall length of the cylinder 100 is at its maximum, and the retracted position, in which the overall length of the cylinder 100 is at its minimum, in response to the introduction of pressurized fluid through the head port 156 and the rod port 160, respectively (FIG. 2). To move the piston assembly 108 to its retracted position, pressurized hydraulic fluid is introduced through the rod port 160 to pressurize the rod cavity 152. When pressure in the rod cavity 152 exceeds pressure in the head cavity 148, the piston assembly 108 moves toward the head end 112 of the barrel 104, in the direction of arrow A in FIG. 3. As the piston assembly 108 moves in the direction of arrow A, displaced hydraulic fluid from the head cavity 148 flows out through the head port 156.

Figure 4:
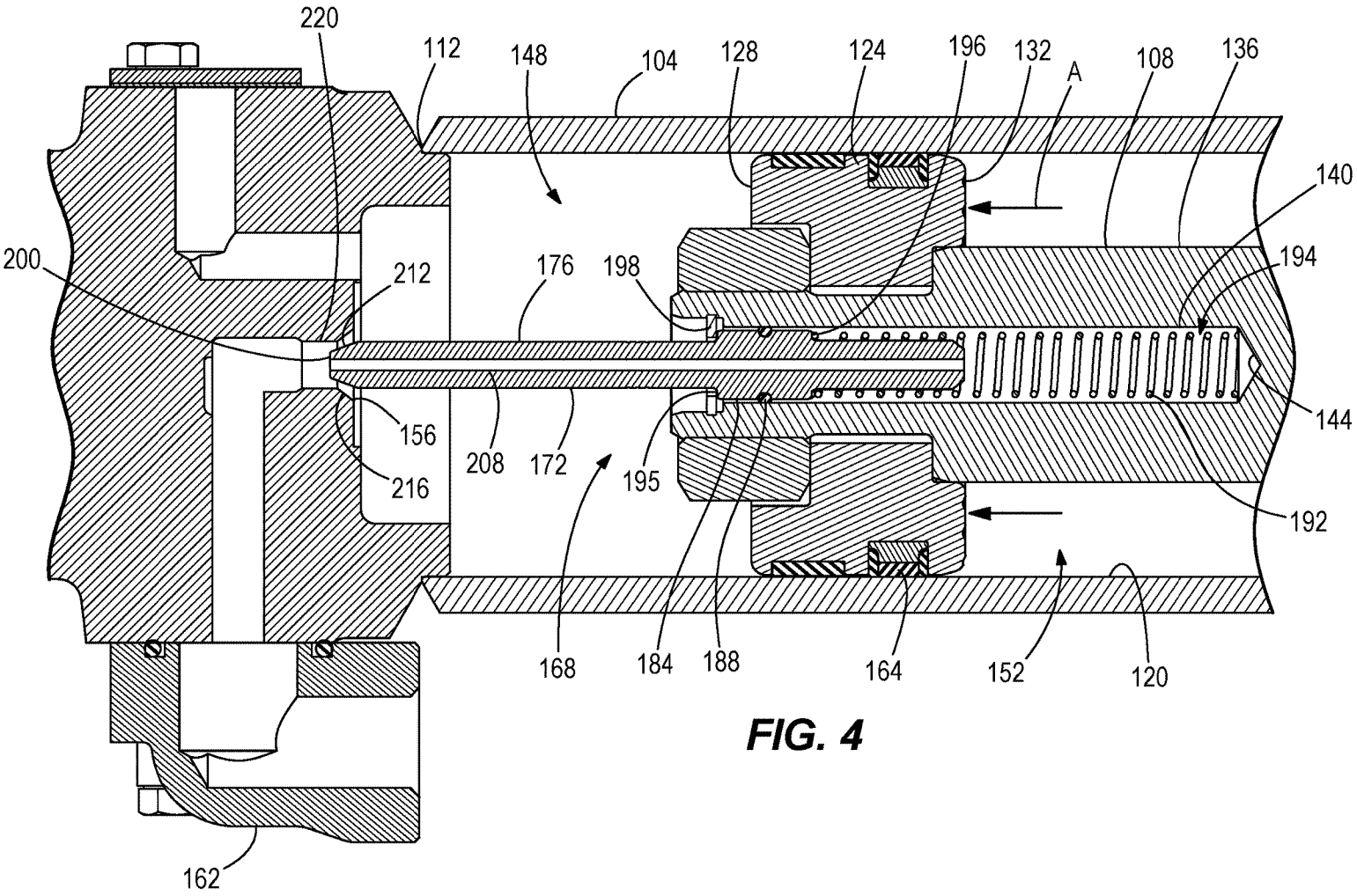
FIG. 4 is a cross-sectional view of a portion of the hydraulic assembly of FIG. 2, illustrating a cushion mechanism of the hydraulic assembly entering an engaged configuration to slow movement of the piston.
Figure 5:
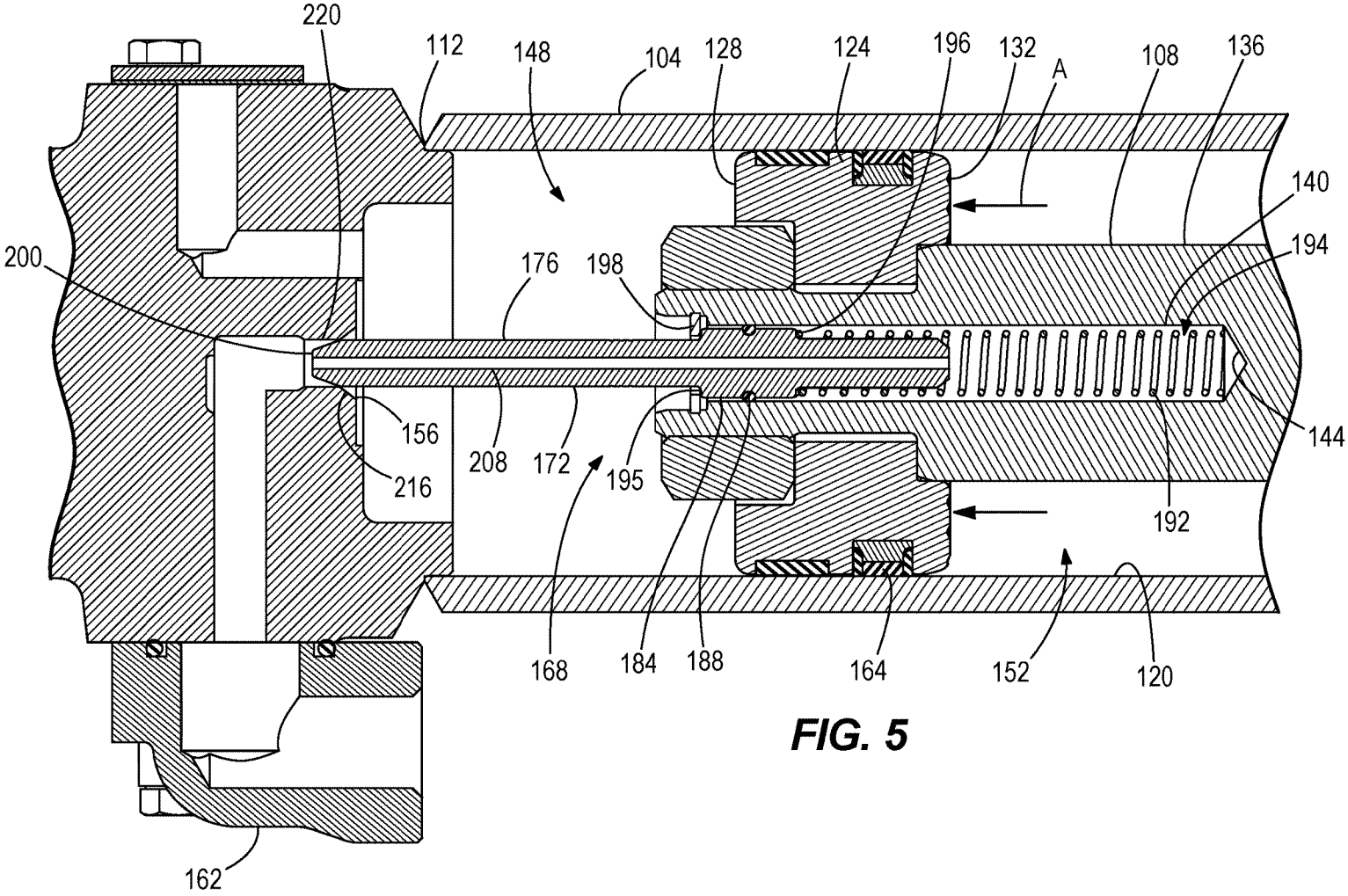
FIG. 5 is a cross-sectional view of a portion of the hydraulic assembly of FIG. 2, illustrating the cushion mechanism in the engaged configuration.

As the piston assembly 108 approaches the head end 112, the first end 200 of the plunger 172 begins to enter the head port 156 (FIG. 4). The presence of the plunger 172 within the head port 156 restricts the outflow of hydraulic fluid through the head port 156. As the piston assembly 108 continues to decrease the volume of the head cavity 148, pressure builds within the head cavity 148, which slows movement of the piston assembly 108 to provide a cushioning effect. As the piston assembly 108 continues to advance in the direction of arrow A, the end 200 of the plunger 172 passes further into the head port 156 and enters a restriction 220 adjacent the tapered inlet region 216. (FIG. 5) The restriction 220 has an inner diameter only slightly larger than an outer diameter of the plunger's main body 176. As such, discharge of hydraulic fluid from the head cavity 148 is substantially inhibited.

Figure 6:
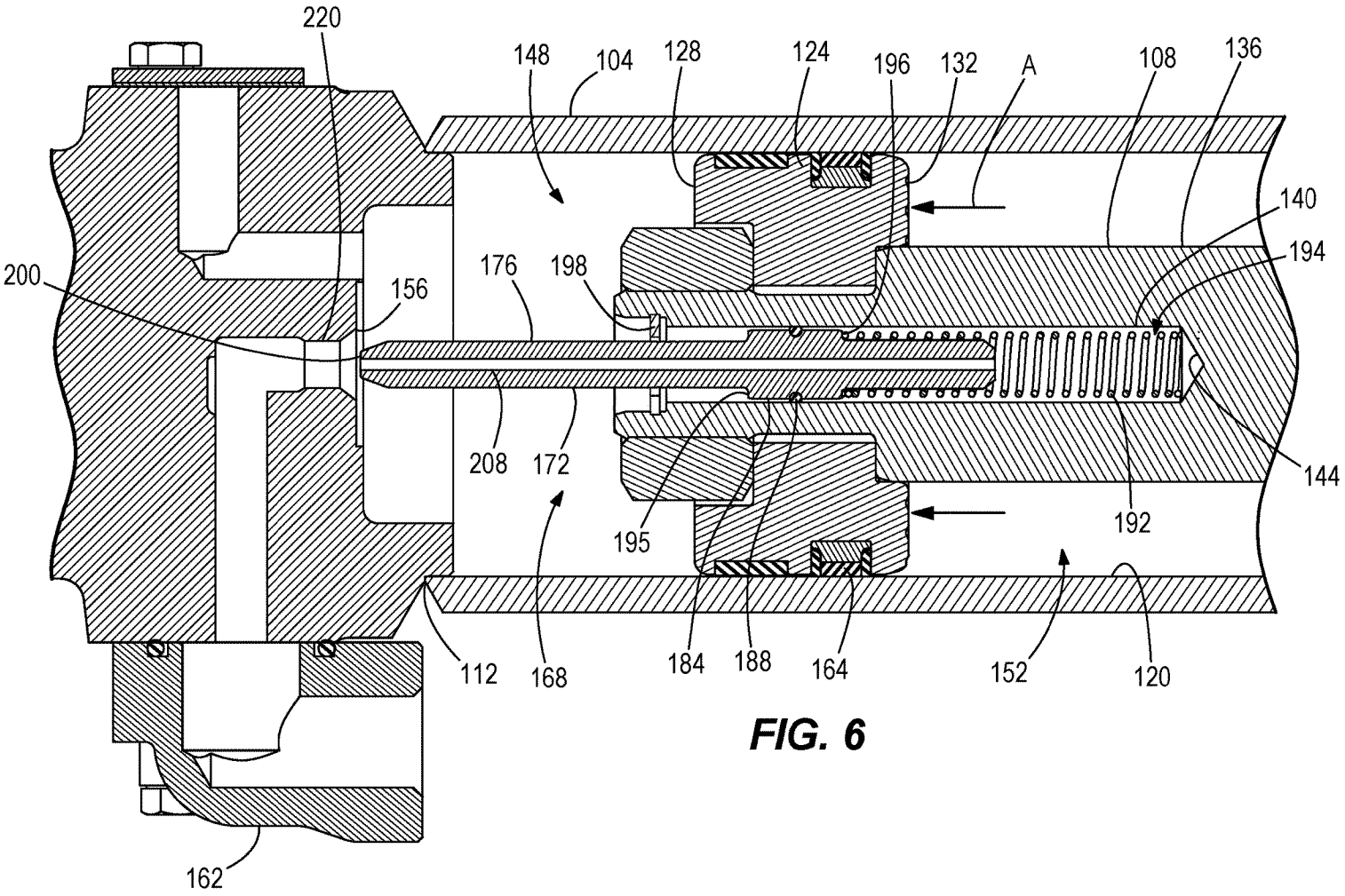
FIG. 6 is a cross-sectional view of a portion of the hydraulic assembly of FIG. 2, illustrating the cushion mechanism in a pressure relief configuration.

As the piston assembly 108 continues to decrease the volume of the head cavity 148, the pressure within the head cavity 148 increases rapidly because the plunger 172 substantially blocks the head port 156. Thus, a pressure imbalance is created, i.e., the pressure within the head cavity 148 is high relative to the pressure within a volume defined by the interior of the head port 156, the spring cavity 194, and the passageway 208, which fluidly connects the interior of the head port 156 and the spring cavity 194. The elevated head cavity pressure acts on the front face 195 of the shoulder 184. When the elevated head cavity pressure exceeds a predetermined cracking pressure of the cushion mechanism 168 (i.e. where the pressure force exerted on the front face 195 of the shoulder 184 exceeds the sum of the spring force and the relatively lower pressure force acting on the back face 196), the plunger 172 retracts into the bore 140, withdrawing the end 200 from the head port 156. (FIG. 6). This pressure relief configuration of the cushion mechanism 168 allows hydraulic fluid to again flow through the head port 156 and relieves pressure within the head cavity 148. As the plunger 172 retracts, hydraulic fluid from the spring cavity 194 is displaced through the passageway 208.

Once the head cavity pressure falls below the cracking pressure, the plunger 172 extends back into the head port 156 under the influence of the spring 192. As the plunger 172 extends, hydraulic fluid flows back into the spring cavity 194 through the passageway 208. The plunger 172 continues to reciprocate between its extended and retracted positions until the piston assembly 108 reaches the head end 112 of the barrel 104. The degree of engagement of the plunger 172 in the head port 156 is dependent on the balance between the pressure in the head cavity 148 and the force exerted by the spring 192. Thus, the cushion mechanism 168 is operable both to slow movement of the piston assembly 108 and to mitigate corresponding increases in pressure within the head cavity 148, without requiring any external relief valves.

To extend the piston assembly 108, pressurized hydraulic fluid is introduced through the head port 156 to pressurize the head cavity 148. Initially, while the plunger 172 is received within the head port 156, a small amount of hydraulic fluid may flow through the interface between the main body 176 and the restriction 220 to enter the head cavity 148. When pressure in the head cavity 148 exceeds pressure in the rod cavity 152, the piston assembly 108 moves toward the rod end 116. As the piston assembly 108 moves, the spring 192 returns the plunger 172 to its extended position, while hydraulic fluid flows through the passageway 208 and into the spring cavity 194.

Various features of the invention are set forth in the following claims.

What is claimed is:

1. A hydraulic assembly comprising:

a barrel having a head port disposed proximate a first end of the barrel;

a piston assembly disposed within the barrel and movable relative to the barrel, the piston assembly including a piston having a first side in fluid communication with the head port, the first side of the piston and the first end of the barrel defining a head cavity therebetween, and a bore extending through the first side and terminating at a back wall; and a cushion mechanism configured to slow movement of the piston assembly relative to the barrel, the cushion mechanism including a plunger at least partially received within the bore and movable along the bore, the plunger including a main body having an end facing the head port and a shoulder extending radially-outwardly from the main body, and a spring disposed in a first region defined between the shoulder and the back wall of the bore, the spring configured to exert a spring force on the plunger to bias the plunger toward the head port, wherein the end of the plunger is configured to enter the head port as the piston approaches the first end of the barrel, and wherein the cushion mechanism is configured such that increased pressure within the head cavity exerts a force on the plunger to move the plunger into the bore and move the end of the plunger out of the head port.

2. The hydraulic assembly of claim 1, further comprising a passageway extending through the main body of the plunger, the passageway fluidly communicating the first region and the end of the plunger.

3. The hydraulic assembly of claim 2, wherein the passageway is configured to allow hydraulic fluid to flow out of the first region as the plunger moves toward the back wall.

4. The hydraulic assembly of claim 2, wherein the plunger defines a longitudinal axis, and wherein the passageway extends along the longitudinal axis.

5. The hydraulic assembly of claim 4, wherein the piston, the barrel, and the head port are coaxial with the longitudinal axis.

6. The hydraulic assembly of claim 2, further comprising a seal disposed between the periphery of the shoulder and the bore.

7. The hydraulic assembly of claim 2, wherein the plunger is positionable in the head port such that the first region, the passageway, and an interior of the head port define a volume, and wherein pressure within the head cavity is greater than pressure within the volume.

8. The hydraulic assembly of claim 1, wherein the piston assembly is movable relative to the barrel between an extended position and a retracted position, and wherein the piston approaches the first end of the barrel when the piston assembly moves toward the retracted position.

9. The hydraulic assembly of claim 8, wherein the barrel includes a rod port disposed proximate a second end of the barrel opposite the first end, and wherein the piston assembly is movable toward the extended position in response to the introduction of pressurized hydraulic fluid through the head port, and wherein the piston assembly is movable toward the retracted position in response to the introduction of pressurized hydraulic fluid through the rod port.

10. A hydraulic assembly comprising:

a barrel having a head port disposed proximate an end of the barrel;

a piston assembly disposed within the barrel and movable relative thereto, the piston assembly including a bore terminating at a back wall, the bore defining a longitudinal axis; and a cushion mechanism configured to slow movement of the piston assembly relative to the barrel, the cushion mechanism including a plunger at least partially received within the bore and translatable along the longitudinal axis, the plunger including a main body having an end facing the head port, a shoulder extending radially-outwardly from the main body, and a passageway extending through the main body; and a spring disposed in a first region defined between the shoulder and the back wall, the spring configured to exert a biasing force on the shoulder, wherein the end of the plunger is configured to enter the head port as the piston assembly approaches the end of the barrel, wherein the cushion mechanism is configured such that increased pressure within the head cavity exerts a force on the plunger to move the plunger into the bore, and wherein the passageway is configured to allow hydraulic fluid to flow out of the first region in response to the plunger moving toward the back wall.

11. The hydraulic assembly of claim 10, wherein the passageway is configured to allow hydraulic fluid to flow into the first region in response to the plunger moving away from the back wall.

12. The hydraulic assembly of claim 10, wherein the passageway extends along the longitudinal axis.

13. The hydraulic assembly of claim 12, wherein the piston assembly, the barrel, and the head port are coaxial with the longitudinal axis.

14. The hydraulic assembly of claim 10, further comprising a seal disposed between the shoulder and the bore.

15. The hydraulic assembly of claim 10, wherein the plunger is positionable in the head port such that the first region, the passageway, and an interior of the head port define a volume, and wherein pressure within the head cavity is greater than pressure within the volume.

16. A hydraulic assembly comprising:

a barrel having a head port disposed proximate an end of the barrel;

a piston assembly disposed within the barrel and movable relative thereto, the piston assembly including a bore terminating at a back wall, the bore defining a longitudinal axis;

a plunger at least partially received within the bore and translatable along the longitudinal axis, the plunger including a main body having an end facing the head port, a shoulder extending radially-outwardly from the main body, and a passageway extending through the main body; and a spring disposed in a first region defined between the shoulder and the back wall, the spring configured to exert a biasing force on the shoulder, wherein the passageway is the sole path for hydraulic fluid to flow into and out of the first region.

17. The hydraulic assembly of claim 16, wherein the end of the plunger is configured to enter the head port as the piston approaches the end of the barrel.

18. The hydraulic assembly of claim 17, wherein the plunger is positionable in the head port such that the first region, the passageway, and an interior of the head port define a volume.

19. The hydraulic assembly of claim 16, wherein the piston assembly, the barrel, the head port, and the passageway are coaxial with the longitudinal axis.

* * * * *